US005276930A

United States Patent [19]

Parramore

[11] Patent Number: 5,276,930

[45] Date of Patent: Jan. 11, 1994

[54] FOLDING TRANSPORTABLE BRIDGE

[75] Inventor: Thomas S. Parramore, Dorset, England

[73] Assignee: The Secretary of State for Defense in Her Britannic Majesty's Government of the United Kingdom of Great Britain and Northern Ireland, London, England

[21] Appl. No.: 671,836

[22] PCT Filed: Sep. 8, 1989

[86] PCT No.: PCT/GB89/01061

§ 371 Date: Apr. 3, 1991

§ 102(e) Date: Apr. 3, 1991

[87] PCT Pub. No.: WO90/02845

PCT Pub. Date: Mar. 22, 1990

[30] Foreign Application Priority Data

Sep. 12, 1988 [GB] United Kingdom ..... 8821298

[51] Int. Cl.[5] ..... E01D 15/12; B60N 3/12

[52] U.S. Cl. ..... 14/2.5; 296/37.5

[58] Field of Search ..... 14/2.5; 296/24.1, 37.6, 296/37.5; 52/223R; 211/195, 198; 182/163, 164, 156, 152, 127

[56] References Cited

U.S. PATENT DOCUMENTS

| | | | |
|---|---|---|---|
| 4,228,625 | 10/1980 | Ruffer et al. | 52/223 R |
| 4,663,793 | 5/1987 | Parramore | 14/2.5 |
| 4,665,577 | 5/1987 | Parramore | 14/2.5 |

FOREIGN PATENT DOCUMENTS

| | | |
|---|---|---|
| 0280626 | 8/1988 | European Pat. Off. . |
| 2017489 | 10/1971 | Fed. Rep. of Germany . |
| 1569713 | 6/1969 | France . |
| 2597129 | 10/1987 | France . |

*Primary Examiner*—Kenneth J. Dorner
*Assistant Examiner*—Nancy P. Connolly
*Attorney, Agent, or Firm*—Nixon & Vanderhye

[57] ABSTRACT

A folding bridge comprising the two sections (27 and 28) hinged together about a hinge pin (43). The hinge being arranged such that when the bridge is folded together for transportation the sections (27 and 28) at least partially nest inside one another in order to reduce the overall height of the folded bridge. The invention also provides a folding bridge in combination with a vehicle for launching and recovering the bridge.

11 Claims, 4 Drawing Sheets

FOLDING TRANSPORTABLE BRIDGE

BACKGROUND OF THE INVENTION

1. Field of the Invention

The present invention relates to the field of folding multi-section bridges and is primarily concerned with the hingeing of the sections.

2. Discussion of Prior Art

It is well known to deploy transportable bridges directly from launch vehicles to enable rapid crossing of obstructions for example rivers and ditches by vehicles such as tanks.

Bridges suitable for this purpose are commonly constructed from two sections that are hinged together in end to end relation. Each section usually comprising a pair of spaced parallel trackways which constitute the upper surfaces of box section girders which are open on-their lower faces. The trackways are spaced by transverse beams welded to the sides of the box section girders which face one another. The spacing between the trackways being chosen to accommodate the track or wheel spacing of the vehicles for which the bridge is designed.

The two bridge sections are joined by hinges each of which extends across the width of a trackway, and permit the bridge to fold from a deployed configuration in which the trackways of two sections are aligned to a folded configuration in which one section lies on top of the other, and the trackways are outermost.

One major disadvantage of the bridges currently in use is that the height occupied by a folded bridge is at least the sum of the section depths. When a bridge is to be transported on a vehicle in the folded configuration, the combined height, length and width of the vehicle and the bridge are subject to limitations such as road bridge height, curvature of minor roads and carriage way width respectively.

Summary of the Invention

It has now been discovered that by partially nesting the folded bridge parts, a number of great advantages can be gained. Partial nesting of the sections allows (a) greater girder depths to be used which in turn allows longer spans to be employed and (b) the possibility of transporting a bridge with three sections nested on top of one another which does not exceed the height limitation when combined with an associated launch vehicle.

Thus according to the invention a folding transportable bridge is provided comprising at least two bridge sections and at least one hinge joining the two bridge sections together end to end, the two bridge sections being rotationally unfoldable between a folded and an unfolded configuration about the hinge wherein the two bridge sections at least partly nest together when the two bridge sections are in the folded configuration.

In order to limit the rotational unfolding of the bridge sections the bridge is preferably provided with at least one extension on one bridge section and at least one stop on an adjacent bridge section, the stop being spaced radially from the hinge on one bridge section, whereby it contacts the extension of the other bridge section when the bridge sections are unfolded.

So that the load on the stops can be reduced the stop is preferably spaced longitudinally from the hinge along the length of the bridge section.

Preferably one of the bridge sections is provided with a cut away which allows the extension of one bridge section to pass through a position in which the two bridge sections are mutually perpendicular.

So as to cut down the weight of the bridge while still permitting vehicles to use it, each bridge section preferably comprises a pair of spaced parallel trackways. Alternatively each section may comprise a single trackway only.

Each trackway preferably constitutes the upper surfaces of a box section girder which section may be open on its lower side.

When the bridge comprises two sections each of which comprises a pair of girders each bridge section preferably comprises an inner girder and an outer girder which are dimensioned to cooperate with an outer girder and an inner girder respectively of the adjacent bridge section. This arrangement has the advantage that both extreme ends of the bridge are identical which facilitates the recovery of the bridge from the opposite end to that which it was launched from.

When two nesting girders are the same size the nesting will be effected by part of each girder being received in the other.

The hinge preferably includes a hinge pin which is resiliently mounted and thus allows the forces of a load passing over the bridge to be borne by major structural members of the bridge sections rather than the hinge itself.

The invention also provides a folding bridge in combination with a launch vehicle which is adapted to carry the bridge in its folded configuration and deploy or recover the bridge from either end.

BRIEF DESCRIPTION OF THE DRAWINGS

The invention will now be described by way of example only with reference to the accompanying drawings in which.

DETAILED DISCUSSION OF PREFERRED EMBODIMENTS

Figure 1:
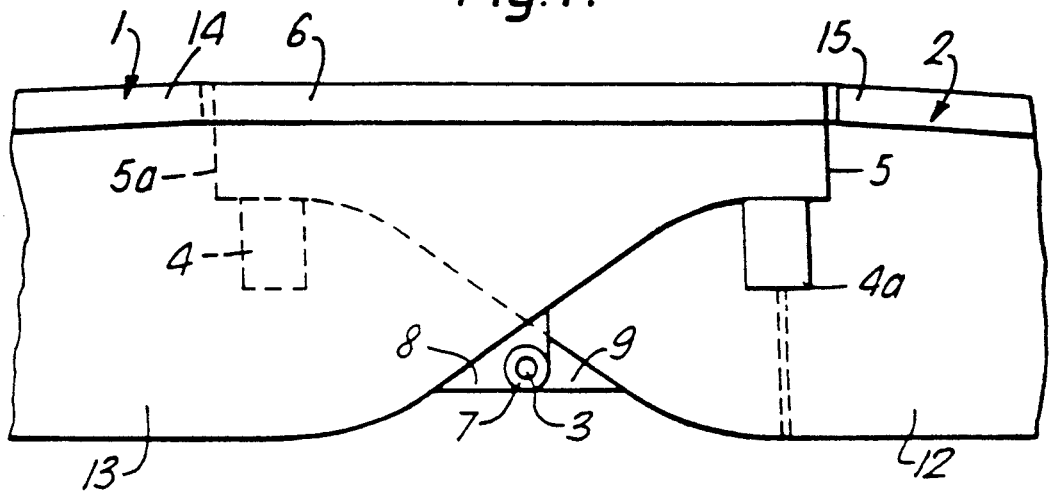
FIG. 1 is a part side elevation of a single trackway bridge in its unfolded state showing the hinge.
Figure 2:
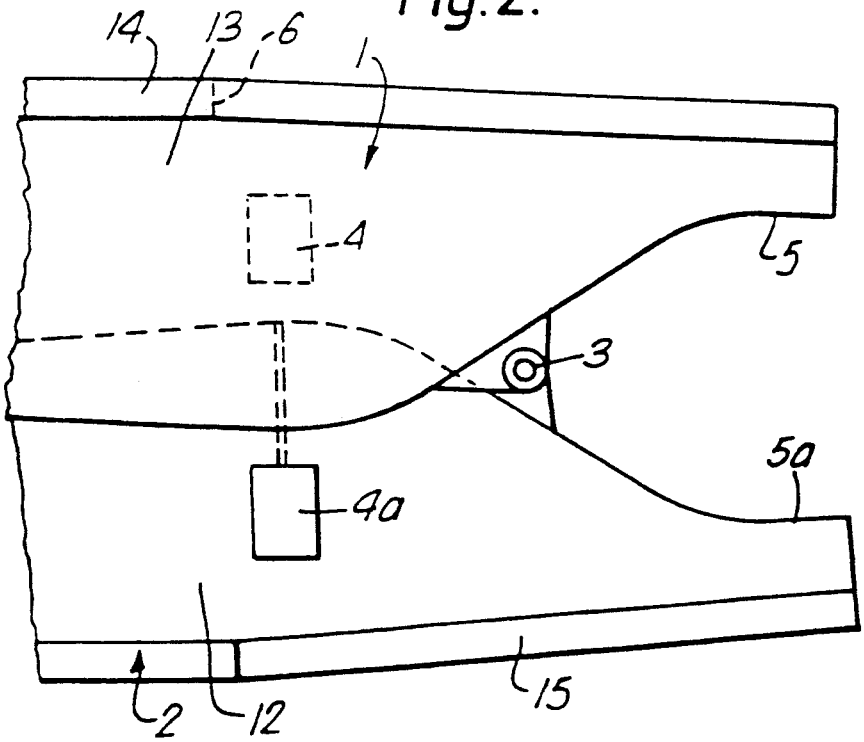
FIG. 2 is a part side elevation of a single trackway bridge in its folded state showing the hinge.
Figure 3:
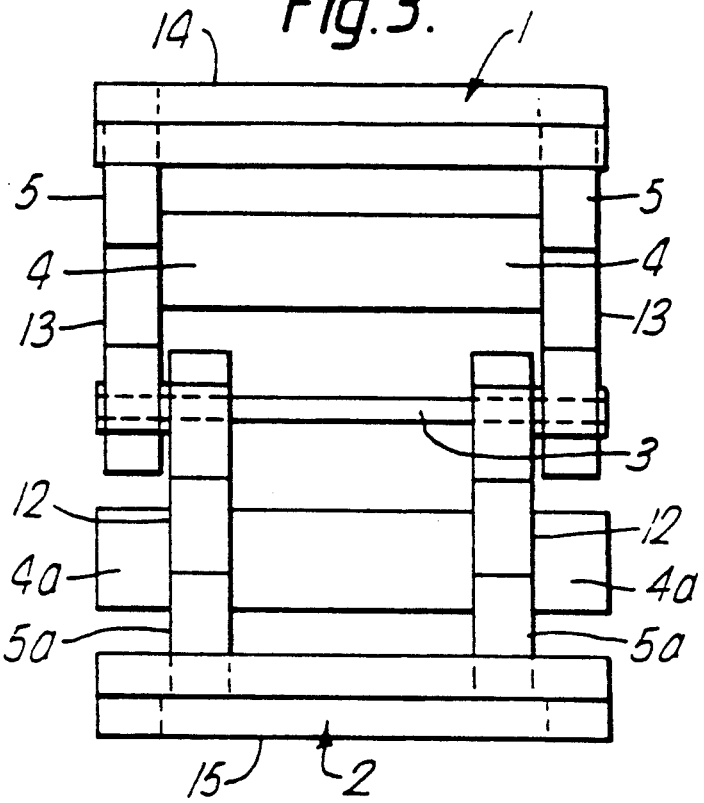
FIG. 3 is an end elevation of a single trackway bridge in its folded state showing the hinge.

For the purpose of describing the joint construction reference will be made to FIGS. 1 to 3 which show a two section bridge in which each section comprises only one trackway. Like parts are designated by like numerals in FIGS. 1 to 3.

The bridge comprises a first section 1 and a second section 2, which are joined by a hinge pin 3 housed in resilient mounting 7. Part 1 comprises a pair of vertical webs 13 surmounted by a trackway 14, and section 2 similarly comprises webs 12 surmounted by a trackway 15. The webs 12 of the second section 2 are closer together than the webs 13 of the first section 1 so that the webs 12 of the second section can fit between those of the first section. The webs 13 of the first section I have stop 4 welded to their insides and extensions 5, similarly the webs 12 of the second section have stops 4a welded to their outsides and extensions 5a. The stops 4 and 4a and extensions 5 and 5a are arranged so that when sections 1 and 2 have been unfolded so that they are in line with one another the stops 4 and 4a prevent further rotational unfolding of the bridge.

The trackway 14 of the wider section 1 is provided with a cutaway 6 which enables the extension 5a to pass through the plane of the trackway 14 when the bridge is being folded. Due to the fact that the hinge pin 3 is located above the lowest level of the webs 12 and 13, the webs 12 of the second section 2 partially nest inside the webs 13 of the first section 1 when the bridge is in the folded configuration as shown in FIGS. 2 and 3.

In order to describe how a two section bridge is deployed reference will now be made to FIGS. 4 to 7 which show a two section twin trackway bridge with its associated launch vehicle performing the launch sequence.

Figure 4:
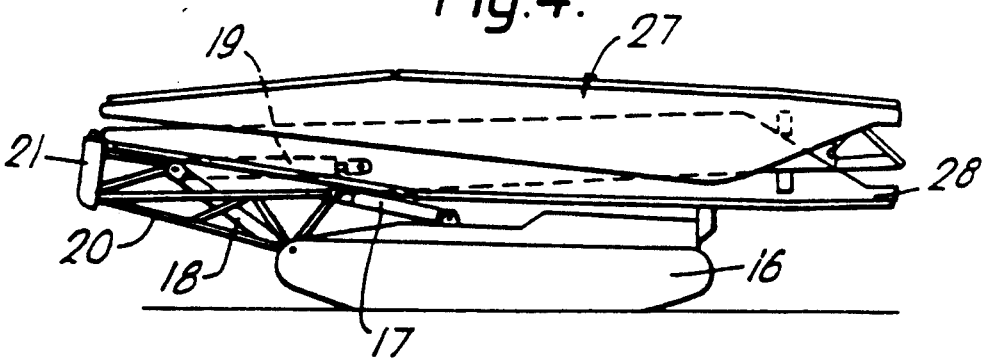
FIG. 4 is a side elevation of a twin trackway bridge in its folded state mounted on an associated launching vehicle.
Figure 5A:
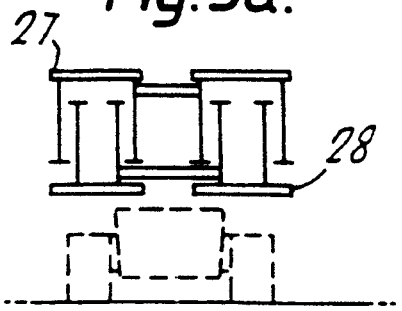
FIG. 5*a* is a rear end elevation of a twin trackway bridge in its folded configuration mounted on an associated launching vehicle in which the trackways of one section nest inside trackways of the other.
Figure 5B:
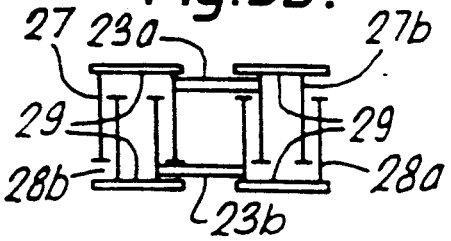
FIG. 5*b* is similar to FIG. 5*a* but shows a bridge in which each section comprises an inner and an outer trackway.

The folding bridge shown in FIGS. 4 to 7 comprises two sections 27 and 28 each of which comprises two trackways 29 as shown in FIG. 5b. One trackway of section 27 is welded to an outer girder 27a and the other is welded to an inner girder 27b. Similarly one trackway of section 28 is welded to an outer girder 28a and the other is welded to an inner girder 28b. The inner and outer girders of section 27 are joined by a lifting beam 23a, and those of section 28 are joined by lifting beam 23b. Sections 27 and 28 are connected by hinge pins 43 (see FIG. 6).

FIG. 4 shows a side elevation of the two section bridge in its folded configuration on a launch vehicle 16.

Figure 6:
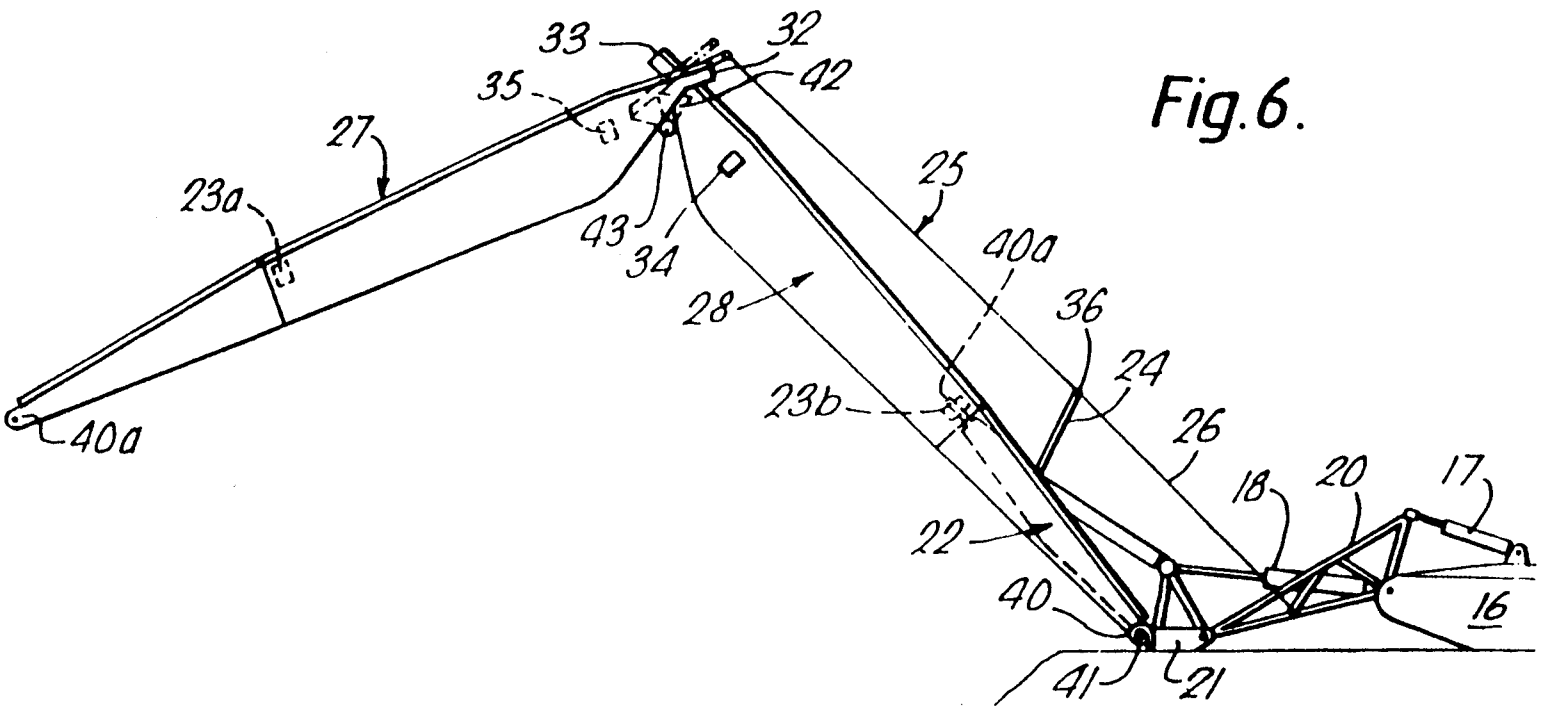
FIGS. 6 and 7 show sequential stages in the launching procedure of a twin-trackway bridge controlled by scissoring rods.
Figure 7:
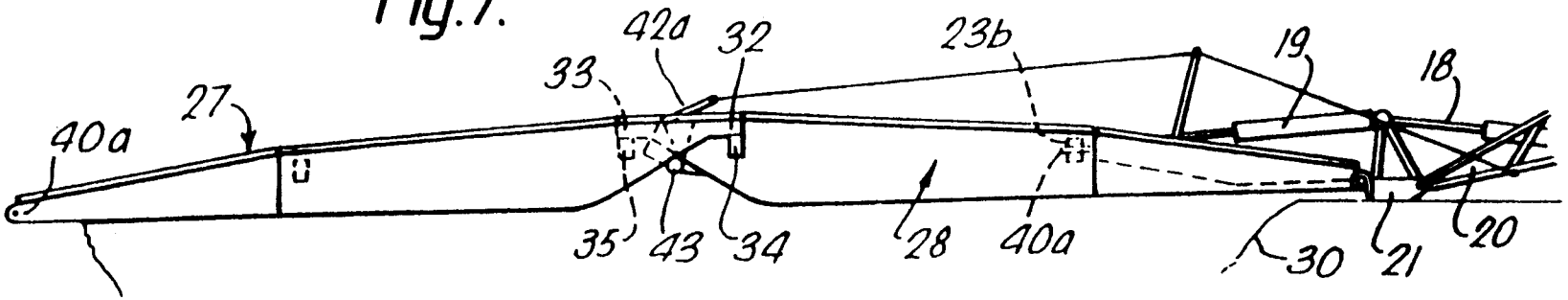

FIG. 6 illustrates how the various elements of the launching mechanism are connected. A launch frame 20 is rotatably attached to the front end of the launch vehicle 16 and its position relative to the vehicle is controlled by the first stage cylinders 17 (only one shown). A pedestal 21 is rotatably attached to the end of the launch frame 20 which is remote from the launch vehicle and the pedestal's position relative to the launch frame is controlled by the second stage cylinders 18 (only one shown). A probe 22 is rotatably attached to the pedestal 21 and its position relative to the pedestal is controlled by a third stage cylinder 19. The end of the probe 22 remote from the pedstal 21 is designed to be a sliding fit in a hole in a lifting beam 23b. The probe may engage lifting beam 23a or 23b depending on which end of the bridge the launch vehicle is operating from. An arm 24 is rotatably attached to the probe 22 and is connected at its upper end to two bridge scissoring rods 25 by an electrically actuable release mechanism 36. The other end of the scissoring rods 25 are attached to quadrants 42 which are rotatable about hinge pins 43 and selectively lockable to the bridge section furthest from the launch vehicle. A quadrant 42 is provided for each trackway and is attached to the bridge scissoring rod 25 by means of a scissoring beam 42a which is attached to the quadrant in such a way that the beam 42a bears near its centre on the quadrant 42 to increase the leverage about the hinge 43. A pair of vehicle scissoring rods 26 are permanently attached between the upper end of arm 24 and launch frame 20. In order to restrain the lower end of bridge section 28, pins 40 are provided on section 28 which engage hooks 41 on the pedestal (similar pins 40a are provided on bridge section 27 in order to facilitate deployment and recovery from that end.)

The launch sequence will now be described with reference to FIGS. 4 to 7. The launch vehicle approaches the edge of the near bank 30 with the bridge in its folded configuration as shown in FIG. 4. The first stage cylinders 17 are extended until the lower end of pedestal 21 as seen in FIG. 4 comes into contact with the ground, after which the second stage cylinders 18 are extended to rotate the pedestal 21 until it is flat on the near bank 30. The final stage of the launching sequence is effected by extension of the third stage cylinder 19 which rotates the probe 22 and bridge section 28 past the vertical position down to a horizontal position. As bridge-section 28 is rotated, the arm 24 is rotated about the end connected to the probe 22 away f rom section 28 by the action of vehicle scissoring rods 26, and in so doing pulls on bridge scissoring rods 25 which rotate quadrants 42 and bridge section 27 away from bridge section 28, as seen in FIG. 6. As the bridge settles into the position shown in FIG. 7 the extensions 32 and 33 contact stops 34 and 35 respectively. While only two extensions and two stops are shown, a twin trackway bridge will in fact have eight of each, there being one associated with each side of each web of each girder.

The scissoring rods 25 are then released from the arm 24 by actuating the release mechanism 36, and allowed to lie between the trackways 29 of bridge section 28. The launch vehicle 16, launch frame 20, pedestal 21, probe 22, arm 24 and rod 26 are then detached from the bridge by releasing hooks 41 from spigots 40 and reversing the launch vehicle away from the bridge, which slideably removes the probe 22 from the lifting beam 23b.

Recovery of the bridge may be effected from either bank and the method employed is a reversal of the launch procedure. The probe 22 is engaged in lifting beam 23a or 23b, the spigots 40 or 40a are engaged in hooks 41, the bridge scissoring rods 25 are attached to arm 24 (having been moved to the other end of the bridge if necessary), and the third stage cylinder 19 is retracted. The bridge folds under the action of its own weight as the probe 22 rotates the bridge section nearest to the launch vehicle into the vertical position.

As seen in FIGS. 4 and 5 when the bridge reaches its folded configuration the inner girders 27b and 28b nest inside the outer girders 27a and 28a of bridge sections 27 and 28 respectively.

Figure 8:
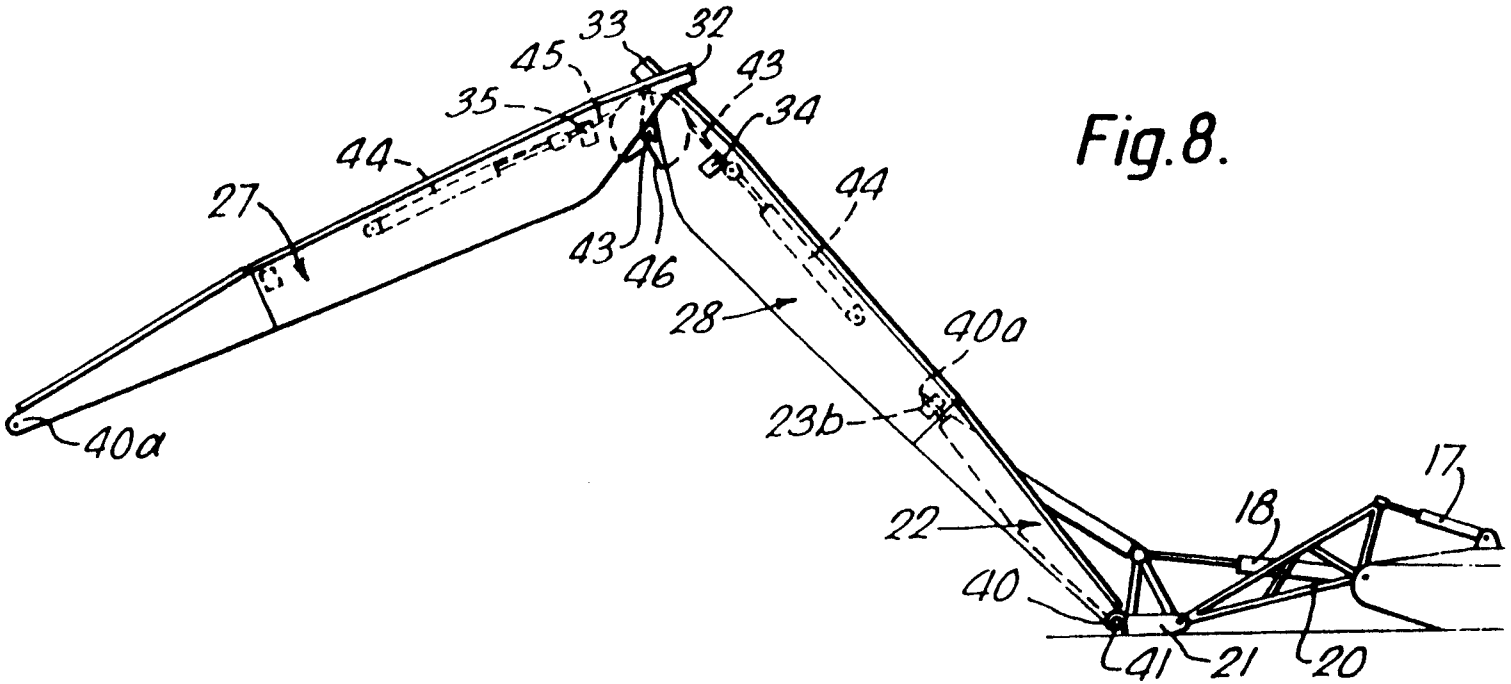
FIGS. 8 and 9 show the sequential stages in the launching of a twin-trackway bridge, controlled by hydraulic rams.
Figure 9:
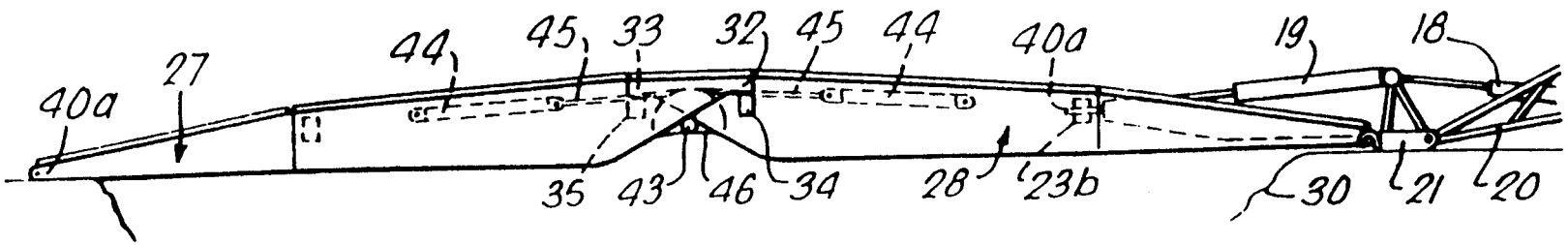

The folding, and unfolding of the bridge may alternatively be controlled by hydraulic cylinders mounted on the bridge. This arrangement is shown in FIGS. 8 and 9, in which like numerals have been used to designate like parts. The difference between the embodiment shown in FIGS. 6 and 7 and that shown in FIGS. 8 and 9 is that the scissoring rods 25, arm 24, and rods 25 and 26 are replaced by hydraulic cylinders 44 and cables 45 which pass round specially adapted quadrants 46 which are fixed to the bridge sections. In addition, hydraulic connections will be required between the bridge and the launch vehicle in order to supply the hydraulic cylinders with pressurised fluid. This arrangement has the advantage that a constant cylinder load to opening torque ratio is maintained.

I claim:

1. A folding transportable bridge comprising:

at least two bridge sections, each section having a maximum section depth; and at least one hinge joining the two bridge sections together end to end, said hinge comprising a means for rotationally folding and unfolding said bridge sections about the hinge, said at least two bridge sections at least partly nest together along a lengthwise distance greater than a distance equal to a sum of said section depths when said at least two bridge sections are in the folded configuration such that total height of said nested bridge sections is less than the sum of the respective section depths.

2. A bridge as claimed in claim 1 wherein one of said at least two bridge sections (1, 2) is provided with at least one extension and the other, adjacent, bridge section is provided with at least one stop, the stop being spaced radially from the hinge, whereby the extension engages the stop when the sections are unfolded in order to limit the rotational unfolding of the two bridge sections.

3. A bridge as claimed in claim 2 wherein the stop is spaced longitudinally from the hinge along the length of the said other bridge section.

4. A bridge as claimed in claim 2 one of the bridge sections is provided with a cutaway which allows the extension of one bridge section to pass through a position in which the two bridge sections are mutually perpendicular.

5. A bridge as claimed in claim 1 wherein each bride section comprises a pair of spaced parallel trackways.

6. A bridge as claimed in claim 5 wherein the trackways constitute the upper surfaces of box section girders.

7. A bridge as claimed in claim 6 wherein at least one of the box section girders is open on its lower side.

8. A bridge as claimed in claim 1 wherein the two adjacent bridge sections comprise at least one complementary pair of girders hinged together, each complementary pair of girders comprising an inner girder and an outer girder, such that the inner girder is nestable within the outer girder.

9. A bridge as claimed in claim 1 wherein each of the two adjacent bridge sections comprise at least one complementary pair of girders hinged together, the complementary girders being substantially the same width and being nestable by part of one girder being received within the other.

10. A bridge as claimed in claim 1 wherein the hinge comprises a resiliently mounted hinge pin.

11. A bridge as claimed in claim 1 in combination with a launch vehicle which is adapted to carry the bridge in its folded configuration and deploy or recover the bridge from either end.

* * * * *